United States Patent [19]

Lonati

[11] 4,233,823

[45] Nov. 18, 1980

[54] DOUBLE-CYLINDER CIRCULAR KNITTING MACHINE

[75] Inventor: Francesco Lonati, Brescia, Italy

[73] Assignee: Costruzioni Meccaniche Lonati S.p.A., Brescia, Italy

[21] Appl. No.: 894,883

[22] Filed: Apr. 10, 1978

[30] Foreign Application Priority Data

Apr. 21, 1977 [IT] Italy ..... 22714 A/77

[51] Int. Cl.[2] ..... D04B 9/10; D04B 15/08

[52] U.S. Cl. ..... 66/14; 66/111

[58] Field of Search ..... 66/14, 111

[56] References Cited

U.S. PATENT DOCUMENTS

| | | | |
|---|---|---|---|
| 2,412,248 | 12/1946 | Bristow | 66/14 |
| 2,737,793 | 3/1956 | Manger | 66/14 |
| 2,959,040 | 11/1960 | Saunders | 66/14 |
| 3,046,760 | 7/1962 | Peberdy | 66/14 |
| 3,564,869 | 2/1971 | Plath | 66/14 |
| 4,073,163 | 2/1978 | Lonati | 66/14 |

*Primary Examiner*—Wm. Carter Reynolds

*Attorney, Agent, or Firm*—Guido Modiano; Albert Josif

[57] ABSTRACT

A double-cylinder circular knitting machine with latch needles and a device for automatically causing the latches of the needles operating in the upper needle cylinder to open before knitting. The device comprises cams defining a path for the needle-free sliders of the lower needle cylinder which lies constantly all around the cam box at a level corresponding to that at which the tips of the sliders engage the latches of the rib needles to open them. The needle-free sliders are selectively passed into this path and are subsequently returned into the normal knitting path when knitting plain fabric. The arrangement of the continuous path at a constant level all around the needle cylinder allows a more simple configuration of the latchguard cams and less wear and stresses in the needle latches.

4 Claims, 2 Drawing Figures

PRIOR ART

DOUBLE-CYLINDER CIRCULAR KNITTING MACHINE

BACKGROUND OF THE INVENTION

This invention relates to a double-cylinder circular knitting machine with latch needles and automatic needle latch opening, i.e. having the needle latches that open automatically before the needles pick up the yarn or thread to be knitted.

More specifically, the invention concerns such a machine capable of carrying out all of the knitting operations commonly carried out on a double-cylinder machine, but having a simpler construction.

A double-cylinder machine is known to be of rather complex construction, and in particular to include a large number of cams for driving the jacks and sliders, part of such cams being movable, i.e. displaceable to two positions differently spaced apart from the needle cylinders such as to only act on the butts of pre-determined sliders or jacks. These movable cams require for their displacement the arrangement of levers or other members around the machine, which complicates the machine design and increases the bulk thereof, since all such levers must derive their motion from the machine programming drum.

Also known is that the cams may induce considerable stresses on the sliders and/or needles, or parts thereof. In particular, it is known that the so-called latchguard cams, mainly provided to hold open the latches of the rib needles operating in the upper needle cylinder, can generate considerable stress in the latches of such needles, which stress becomes higher the narrower is the loop on the needle, since that loop is arranged between the open latch and the needle stem, and lever acts on the latch, which is thus pressed against the latchguard cams.

The latches of the rib needles, moreover, may strike the sloping flanks of the latchguard cams at a more or less open position during the movement of such needles to a floating or neutral position, that is a raised non-knitting position. If a latch is too open, it may happen that the impact on the sloping flank of the latchguard cam, rather than causing the latch to open, bends it, thereby the latch damages and the yarn is no longer allowed to run freely along the latch.

Quite often, during the return stroke of the reciprocating motion in forming the heel of a stocking or sock article, the latches of the needles operating in the lower cylinder are also forced against the lower portion of the latchguard cams.

Those same latchguard cams are also difficult to manufacture and require the availability of skilled labor. Furthermore, they involve considerable waste of material, since they must be made from a single ring, although they only occupy peripherally but part of the cam box circumference.

The various stresses induced in the needles and sliders of a double-cylinder machine also include those caused by the slider pushing cams, so termed because they push the sliders against the bottom of the respective grooves when the needles and sliders cross one another to open the needle latches, which slider pushing cams transmit shocks to the sliders and needles, as these move at a high speed past them.

SUMMARY OF THE INVENTION

It is a primary object of this invention to obviate such drawbacks experienced with the prior art machines.

More specifically, this invention is directed to providing a double-cylinder circular knitting machine wherein those members which are intended to form the loops undergo less stress and wear than in the prior art machines, with the attendant obvious advantage of a longer life.

It is a further object of this invention to provide a machine as specified above, which is of a simpler construction than a conventional double-cylinder machine suitable for carrying out the same knitting functions.

These and other objects, such as will be apparent hereinafter, are achieved by a double-cylinder circular knitting machine with latch needles and automatic needle latch opening, characterized in that the cam box associated with the lower needle cylinder comprises cams defining, for the control butts of the needle-free sliders of the lower cylinder, a non-knitting track extending substantially continuously at the level corresponding to the latch opening level of the upper cylinder needles provided by said sliders, and that means is provided for selectively bringing to said track the needle-free sliders of the lower cylinder, as well as means to return said sliders to the knitting track.

In a machine of this type, the sliders, whereto correspond needles operating in the upper cylinder, i.e. the protective sliders having the function of opening the latches of the overlying needles, are held with their control butts in a track other than the knitting one, wherein the control butts of all the other sliders of the lower cylinder needles move. In this manner, unnecessary raising and lowering movements of the protective sliders are effectively avoided, thereby minimizing the stress and wear of these sliders and various cams, and above all it becomes possible to eliminate several movable cams and several fixed cams, as it will appear hereinafter. Thus, in a machine so designed, the intervention of the jacks to assist the protective sliders movements is no longer required, as these move independently with their control butts in the non-knitting track, the intervention of such jacks being limited to those moments when the protective sliders are to be shifted to bring their control butts from the knitting track to the non-knitting track. In a machine to this design, it is further possible to reduce the size of the latchguard cams, since the latch opening function is provided, for part of their path, by the protective sliders themselves which are purposely movable with their control butts in the non-knitting track. This also affords a simplification of the latchguard cams, with attendant advantages not only from the viewpoints of the material and labor economy, but also of a reduction of the stresses on the needle latches.

BRIEF DESCRIPTION OF THE DRAWINGS

Further features and advantages of the invention will become more apparent from the ensueing description of a preferred but not restrictive embodiment of a machine according to the invention, provided herein by way of example only and illustrated in the accompanying drawings, where.

DESCRIPTION OF THE PREFERRED EMBODIMENTS

Figure 1:
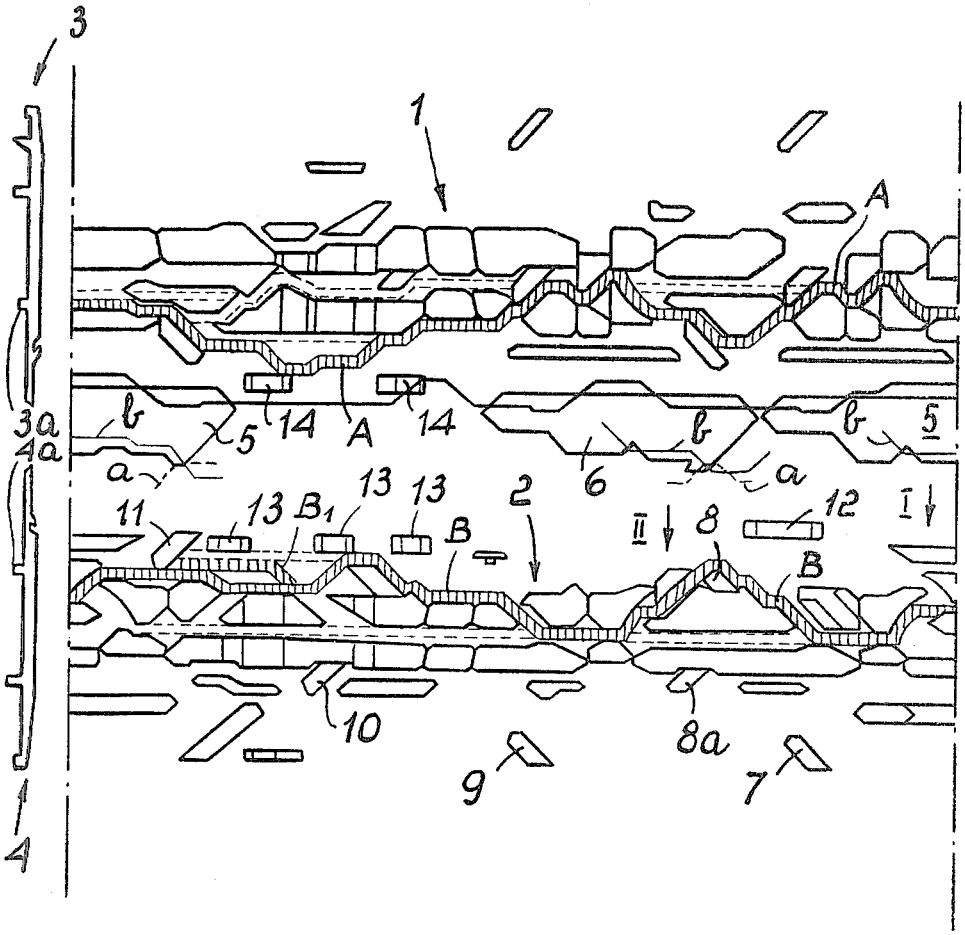
FIG. 1 is a developed representation of the central and upper portions of the cam box in a conventional machine.

With initial reference to FIG. 1, the characters I and II denote two yarn feeds, the numeral 1 denotes the cam box associated with the upper needle cylinder and the numeral 2 the one associated with the lower needle cylinder. The characters A and B denote two knitting tracks respectively engaged by the control butts 3*a* and 4*a* of the sliders 3 and 4, which are movable respectively in the upper cylinder and lower cylinder.

As known in the art, the track B is followed for the most part of its development by the control butts 4*a* of the sliders 4 carrying needles intended to form loops at a given feed, as well as by the control butts 4*a* of the sliders which are needle-free, this latter needles being hooked to the overlying sliders 3 of the upper cylinder and forming rib stitches under the drive by this sliders. The needle-free sliders, or protective sliders, which have the function of opening the latches of the overlying rib needles such that the latter are enabled to pick up the yarn at the immediately following feed, deviate with their butts 4*a* from the track B for a short distance only, to follow the path B1. The latches are opened, in a known manner, shortly before the latchguard cams 5, respectively 6, by penetration of the tips of the sliders 4 between the tips of the latches and the hooks of the needles engaged by their respective sliders 3. The lines a and b show respectively the path followed by the tips of the protective sliders and the path followed by the tips of the latches of the needles operating in the upper cylinder during the step preceding and following the latch opening. The latchguard cams 5,6 each prevent the open latches from re-closing, thereby the needles are positively enabled to pick up the yarn at the immediately following feed.

To hold the butts 4*a* of the protective sliders in the track B provision is made, as known in the art, for movable cams 7,8,8*a*,9,10, whereas to bring the butts 4*a* of those same sliders to the path B1, corresponding jacks (not shown) are utilized, being actuated by the machine selection devices, also not shown. To bring the butts 4*a* of the protective sliders back to the track B, a cam 11 is provided.

At 12, 13 and 14 are indicated the slider pushing cams, having the cited function of holding the sliders pressed against the cylinder during the latch opening steps and/or the needle transfer from the lower cylinder to the upper one and viceversa (cams 13 and 14). The remaining cams of the prior art machine will be no longer discussed herein, as bearing no relationship to this invention.

Figure 2:
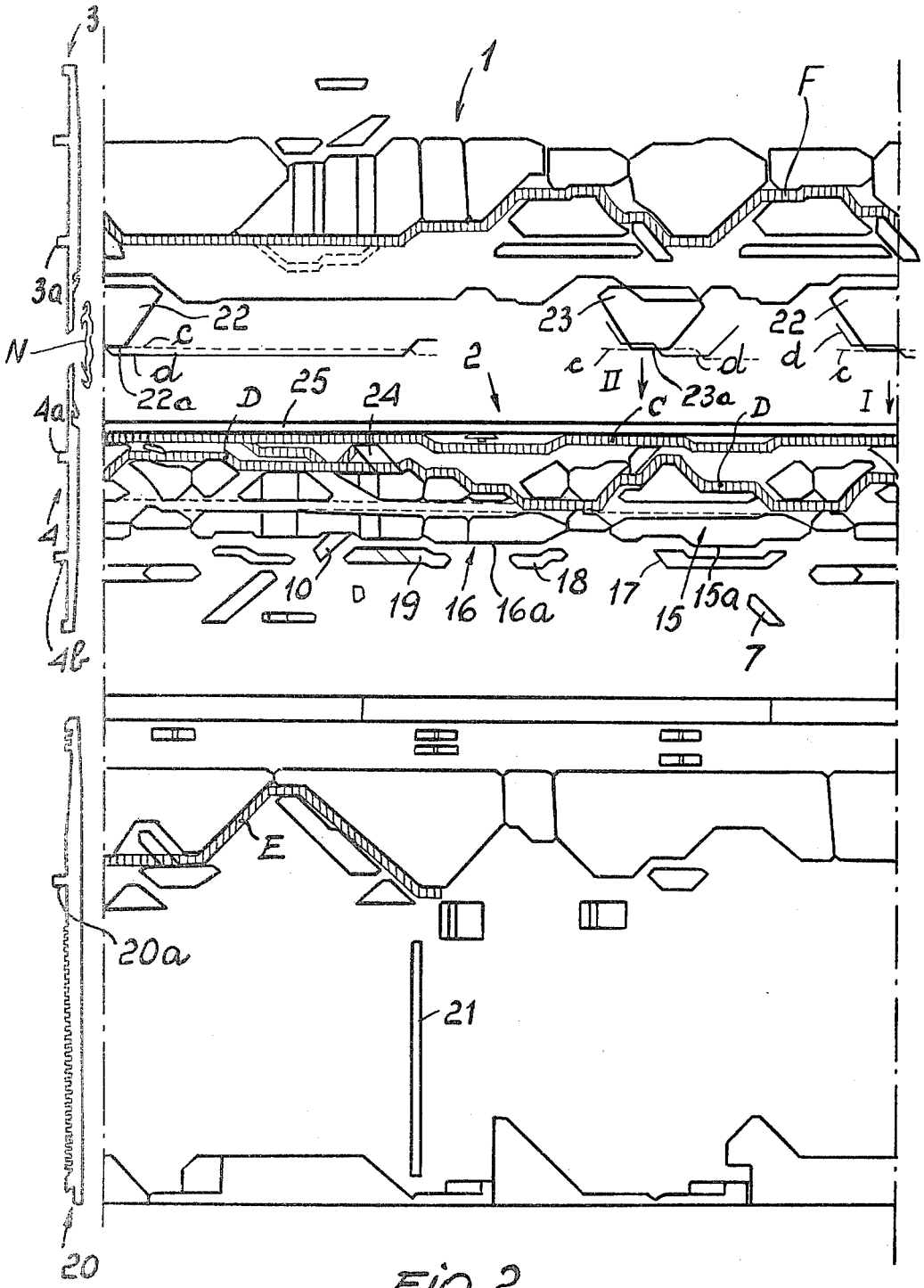
FIG. 2 is a complete developed representation of the cam box in a machine according to this invention.

Making now reference to FIG. 2 of the drawing, where those cams which are similar to the ones in the prior art machine are denoted with like reference numerals, it should be noted that, in accordance with this invention, the cam box 2 associated with the lower cylinder includes cams contoured to hold in a non-knitting track C the butts 4*a* of the needle-free or protective sliders 4, said track extending all around the cam box substantially at a higher level than the top level of the lower knitting track, indicated at D, along which move the control butts 4*a* of the sliders 4 corresponding to the needles knitting in the lower needle cylinder. In the track C, the protective sliders 4 are at a suitable position level to engage and open the latches of the overlying rib needles before the latter take up the yarn at feeds I and II, as represented by the lines c, d, which indicate respectively the path of the tips of the protective sliders 4 and that of the tips of the overlying rib needle latches. Once the tips of the sliders 4 have come into engagement with the latches of the needles N, relative movement between the needles N and the sliders 3,4 causes the latches to be progressively opened in a manner known per se. The control butts 3*a* of the sliders 3 in the upper needle cylinder follow the upper knitting track F.

The knitting cams shown in FIG. 2 are of the type described in copending U.S. application Ser. No. 894,782 by the same Applicant. Reference is therefore made to this Application for what concerns the details of the knitting cams. However, the knitting cams could be of conventional design, excepting, of course, for those parts with which this invention is concerned.

The track C may have a perfectly rectilinear pattern. However, it is preferable to provide therein upper portions and two slightly lower portions, the latter being provided shortly before and shortly after the feed II, by suitably contouring two cams 15 and 16, which have to this purpose corresponding lower lobes 15*a*, 16*a*, respectively. At these lobes, opposing cams or countercams 17, 18 and 19 have corresponding depressions or lower portions, such as to guide accordingly the lower butts 4*b* of the protective or needle free sliders 4. As visible in FIG. 2, cams 15 to 19 cause the needle-free sliders to be slightly lowered such that their control butts 4*a* move slightly below the level of the upper portions of track C along which engagement and opening of the latches of the rib needles occurs. This pattern of track C is particularly advantageous in knitting machines provided with sliders having lateral tabs and with false sinkers housed in the same seats as the conventional loop-holding sinkers. In fact, this pattern of track C allows to eliminate interference between the tabs of the sliders, and the respective false-sinkers, owing to the fact that the tabs of the slightly lowered sliders can no longer hinder the corresponding false-sinkers to move, thus the hooks of the sinkers are left free downwards to hook up the yarn.

Into the non-knitting track C, the protective sliders are selectively brought by means of respective jacks 20, which are associated with the protective sliders and selected by the selection device 21 to move with their butts 20*a* into the track E. In the instance of "derby" or rib knitting, this selection is carried out once for all at the start of the work, and no longer requires to be repeated in succession at every turn, since the protective sliders 4 remain by themselves with their butts 4*a* in the track C. This represents an advantage of this invention over the prior art machines.

In the instance of so-called "links" knitting, the protective sliders 4 are instead all brought by the movable cam 10 with their butts 4*a* back to the knitting track D at every turn, after gripping and hooking the respective needles operating in the upper cylinder, for selection by the selecting device 21. This cam 10 therefore defines means for returning the needle-free sliders with their control butts 4*a* into the lower knitting track D.

It should be noted that the movements of the protective sliders are minimal, and in no case are the sliders requested to follow each time the raising and lowering cams at the various feeds. This results in less wear of the sliders themselves. Furthermore, owing to the constantly raised movement of the protective sliders, it becomes possible to reduce the size of the latchguard cams 22,23, which thus take an extremely simple shape. In fact, since the protective sliders move for an appreciable distance at the opening level of the latches of the rib needles knitting in the upper cylinder, they can ensure such opening action even in the absence of the latchguard cams, which may be left out at certain sections. The maximum dimension of the latchguard cams in a circumferential direction may thus be reduced to less than 1/5 of the entire circumferential extension of the cam box, preferably to about 1/7 of said extension, whilst the lower portions 22*a*, 23*a* may be rectilinear throughout, as shown in FIG. 2. The reduced size of the latchguard cams 22,23, and the simplified shape thereof, afford an economy of material and labor, in addition to reducing the stresses in the open latches of the needles knitting in the upper cylinder. Moreover, the stresses in the latches of the needles knitting in the lower cylinder are removed during the return stroke of the reciprocating movement when forming the heel of a stocking or sock article, since where such stresses were present in the prior art machines, the latchguard cams 22,23 have been eliminated from the machine according to this invention.

As is apparent from a comparison of FIGS. 1 and 2, the movable cams 8*a*, 9 and 11 have been removed from the inventive machine, which also affords the elimination of their respective actuating linkages, thus simplifying the machine construction and reducing the cost thereof. It is also possible to eliminate the movable slider pushing cams 12, 13 and 14, and arrange a fixed ring 25 around the cam shell to hold the sliders pressed against the cylinder, said ring having the additional function of equalizer cam at the various feeds. Thus, there occur no more impacts of the sliders onto the slider pushing cams, and the machine construction is further simplified.

Most advantageously, the raising cam 8 may be omitted, thereby the lower cylinder sliders carrying the knitting needles are not raised unnecessarily to the maximum level defined by the non-knitting track, wherein are movable the control butts 4*a* of the needle-free sliders of the lower cylinder. In this way, the loop are prevented from sliding unnecessarily up and down along the needles, while the tensions induced in the loops when the latter are tightened are also avoided.

As already painted out above, FIG. 2 shows exemplarily the cam box 1 and 2 of a machine the features whereof are described in the cited copending U.S. Application Ser. No. 894,782 by the same Applicant. For this reason, the cam 24 is contemplated to be movable such as to allow the sliders to move with their control butts 4*a* in the track D without being raised, as is the case instead with the prior art machines. With the cam box 1, wherein no provision is made for the floating track for the upper cylinder needles, the respective opened latches are also prevented from striking the sloping flanks or inclines of the latchguard cams. It will be obvious how nothing opposes a configuration of the cam box 1 similar to the one of the prior art machines, excepting, of course, for those parts which belong specifically to this invention.

I claim:

1. A double-cylinder circular knitting machine having an upper and a lower needle cylinder, latch needles movable therein, at least one yarn feed, sliders associated with said latch needles and having control butts, said sliders comprising sliders in said upper needle cylinder having said control butts movable along an upper knitting track to cause corresponding rib needles to knit in said upper needle cylinder, sliders within said lower needle cylinder having said control butts movable along a lower knitting track to cause corresponding needles to knit in said lower needle cylinder, and needle-free sliders within said lower needle cylinder corresponding to said rib needles knitting in said upper needle cylinder, a cam box having cams defining a non-knitting track for said control butts of said needle-free sliders, said non-knitting track having at least portions thereof at a level at which said needle-free sliders engage said rib needles before the latter take up yarn, to cause opening of the latches of said rib needles while said sliders in said upper needle cylinder corresponding to said rib needles move with said control butts along said upper knitting track, means for selectively bringing said needle-free sliders with said control butts into said non-knitting track and means for returning said needle-free sliders with said control butts into said lower knitting track, wherein said non-knitting track is above said lower knitting track all around said cam box.

2. A knitting machine according to claim 1, wherein said cams defining said non-knitting track comprise two cams arranged respectively before and after said at least one yarn feed, and counter-cams associated with said two cams for causing said needle-free sliders to be slightly lowered such that said control butts of said needle-free sliders move slightly below said level of said at least portions of said non-knitting track.

3. A knitting machine according to claim 1, wherein said cam box has a circumferential extension and further comprises latchguard cams having a maximum circumferential dimension which is less than 1/5 of said circumferential extension of said cam box.

4. A knitting machine according to claim 1, further comprising a fixed ring around said lower needle cylinder for holding said sliders in said lower needle cylinder pressed against said lower needle cylinder.

* * * * *